US008214078B1

(12) United States Patent
Sta. Cruz et al.

(10) Patent No.: US 8,214,078 B1
(45) Date of Patent: Jul. 3, 2012

(54) KIOSK FOR DISPENSING ITEMS

(75) Inventors: Romy Michael A. Sta. Cruz, Bulacao Talisay (PH); Bryan Lee Cabatingan, Mandaue (PH)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 13/307,877

(22) Filed: Nov. 30, 2011

(51) Int. Cl.
*G07F 17/00* (2006.01)
*G07F 11/48* (2006.01)

(52) U.S. Cl. ..... 700/243; 700/232; 700/242; 221/88; 221/90; 221/188

(58) Field of Classification Search ..... 700/243, 700/242, 232; 221/105, 90, 88, 188, 190, 221/177, 113, 119
See application file for complete search history.

(56) References Cited

U.S. PATENT DOCUMENTS 2,482,406 A * 9/1949 Findley ..... 298/21 R
4,251,177 A * 2/1981 Neuhaeusser et al. ..... 414/276
4,608,679 A * 8/1986 Rudy et al. ..... 369/30.43
5,508,859 A * 4/1996 Hu et al. ..... 360/92.1
5,927,544 A * 7/1999 Kanoh et al. ..... 221/90
7,747,346 B2 * 6/2010 Lowe et al. ..... 700/242
7,860,606 B2 * 12/2010 Rudy ..... 700/242
8,095,236 B2 * 1/2012 Rudy et al. ..... 700/238
2002/0046122 A1 * 4/2002 Barber et al. ..... 705/17
2004/0254676 A1 * 12/2004 Blust et al. ..... 700/231
2009/0276087 A1 * 11/2009 Murray et al. ..... 700/232

* cited by examiner

*Primary Examiner* — Michael K Collins
(74) *Attorney, Agent, or Firm* — Dana T. Hustins

(57) ABSTRACT

A kiosk and a method for dispensing items therefrom. In various embodiments, the kiosk comprises a shelf system for holding items to be dispensed from the kiosk and a gripper capable of transporting items from the shelf system to a dispenser. The shelf system preferably comprises a series of parallel shelves, each shelf capable of holding one dispensable item. When not in operation, the shelves of the shelf system remain in an inclined position, thereby preventing the items situated thereon from falling off the shelves. To dispense an item, the shelves are rotated into a substantially horizontal position so the gripper may engage the selected item and transport the item to a dispenser.

11 Claims, 7 Drawing Sheets

KIOSK FOR DISPENSING ITEMS

BACKGROUND OF THE INVENTION

Kiosks or vending machines for dispensing items are well known to those of skill in the art. Some kiosks utilize a gripper arm to remove a selected item from its storage area within the kiosk and transport the item to a dispenser. Particularly, some kiosks that dispense DVDs (digital versatile disks), CDs (compact discs), or similar items utilize a rack system in which the DVDs (or similar items) are stored on shelves in a rack within the kiosk. When a customer selects a particular DVD (or other item) from the kiosk for purchase or rental, a gripper arm will travel to the shelf location in the rack to pick up the DVD. The gripper arm will then slide the DVD out of the shelf and transport the DVD to the dispenser slot or chute.

In such prior-art kiosks, a problem may occur if one or more DVDs are not properly and completely located within the confines of the rack system. For example, if a kiosk with a standard rack system is shaken or tilted, one or more DVDs may partially slide out of their respective shelves. In such a situation, the DVDs may obstruct the path along which the gripper arm travels. Thereafter, when a customer selects a DVD for purchase or rental, the gripper arm may collide with a DVD that is in the gripper arm's path of travel. This may cause the gripper arm to jam and/or damage the DVD obstructing its travel path. Furthermore, the gripper arm may not be able to reach the selected DVD and therefore the customer cannot obtain the selected product. In addition, if the gripper arm becomes jammed, then the kiosk may become entirely inoperable.

In other situations, one or more DVDs may become completely dislodged from their respective shelves if the kiosk is greatly tilted or shaken. In such situations, the DVDs may slide out from the rack completely and fall to the floor of the kiosk. Thus, customers could no longer purchase or rent such DVDs.

SUMMARY OF THE INVENTION

Disclosed herein is a kiosk and a method for dispensing items therefrom. In various embodiments, the kiosk comprises a shelf system for holding items to be dispensed from the kiosk. The shelf system preferably comprises a series of parallel shelves, each shelf capable of holding one dispensable item. The kiosk further comprises a gripper that travels along tracks inside the kiosk, thereby enabling the gripper to travel in all three dimensions. The shelf system further comprises one or more servos, actuators, or other devices to retract the shelves. Preferably, the shelves retract in such a manner that the shelves become inclined at an angle above the horizontal when not in use. This inclination of the shelves prevents the DVDs (or other items) being stored on the shelves from falling off the shelves when the kiosk is shaken or tilted.

DETAILED DESCRIPTION

Figure 1:
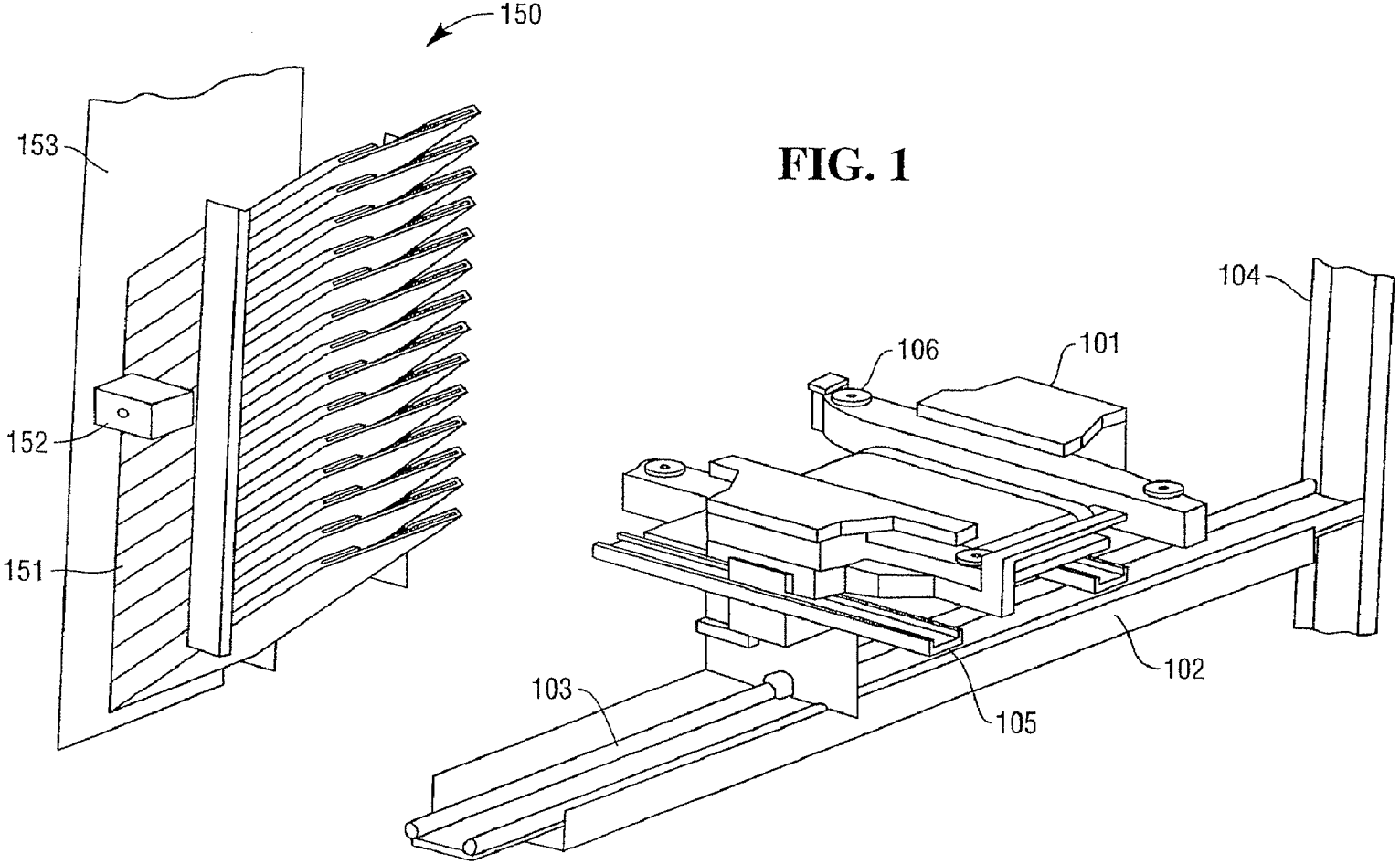
FIG. 1 is a perspective view of a retractable shelving system and a gripper system suitable for use in a kiosk, wherein the shelving system is positioned in an inclined position.

FIGS. 1-7 show perspective views of a retractable shelving system 150 and a gripper 101 suitable for use in a kiosk for dispensing DVDs in one embodiment of the invention. The kiosk preferably comprises a computer for use by the customer to select one or more DVDs. When a customer selects a DVD for purchase or rental, the computer or other control system (not shown) sends a signal to gripper 101 to retrieve the selected DVD. As shown in FIGS. 1-7, the gripper 101 preferably comprises motorized wheels for travelling horizontally along a horizontal track 103. The horizontal track 103 is preferably positioned on top of a gripper arm 102. The gripper arm 102 preferably attached to a vertical track 104 by a second set of wheels (not shown). A motor is preferably attached to each set of wheels to drive the wheels along the respective track. The second set of wheels allows the gripper arm 102 to move in a vertical direction along vertical track 104. These first and second sets of wheels therefore allow the gripper 101 to move in vertical and horizontal directions. As discussed in more detail below, a third set of wheels (coupled to one or more motors) allows the gripper 101 to move along a gripper track 105 in the third dimension. Accordingly, the gripper 101 can be positioned anywhere within a three-dimensional space inside the kiosk.

Figure 2:
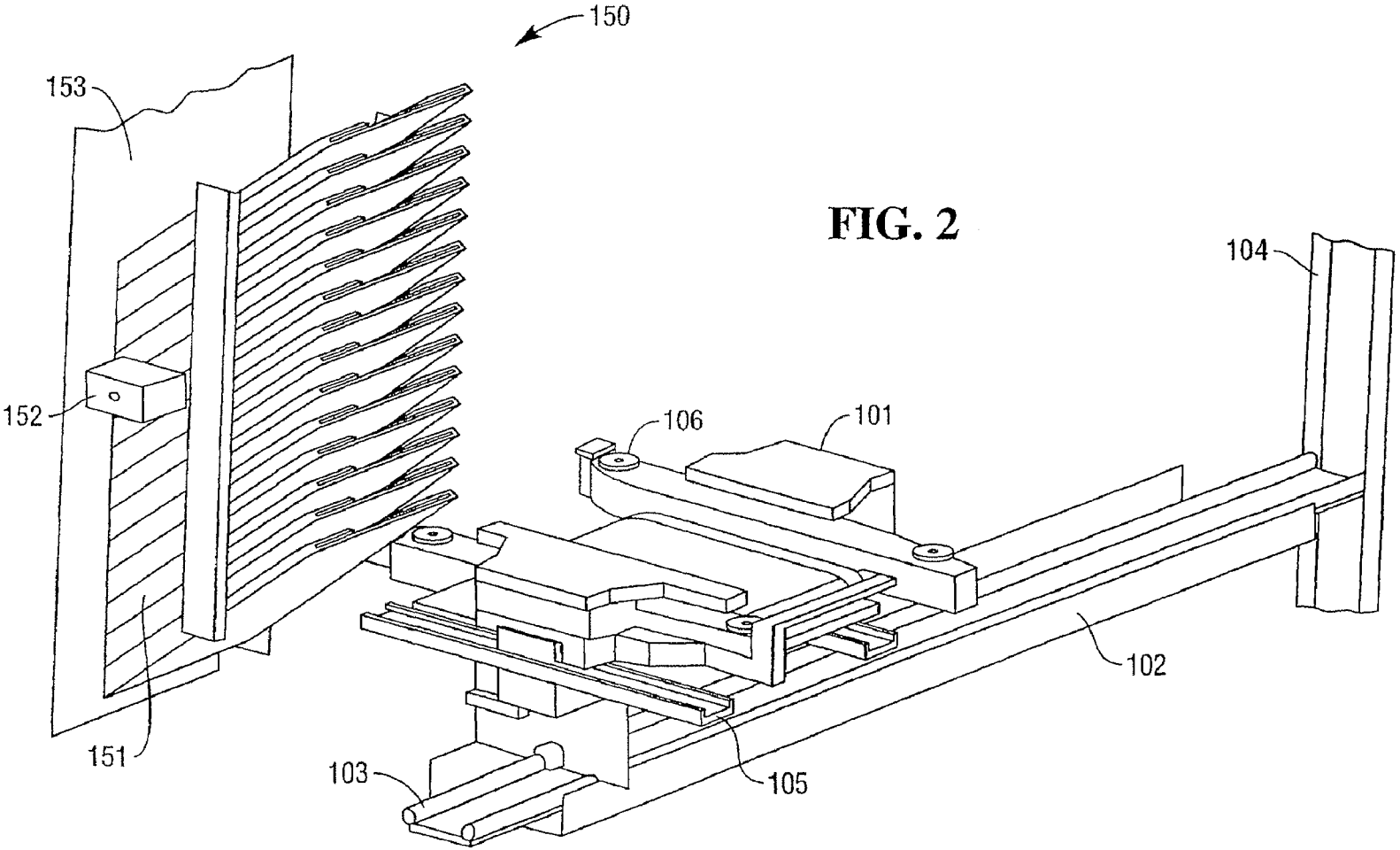
FIG. 2 shows the embodiment of FIG. 1 wherein the gripper has moved along a horizontal track towards the shelving system.
Figure 3:
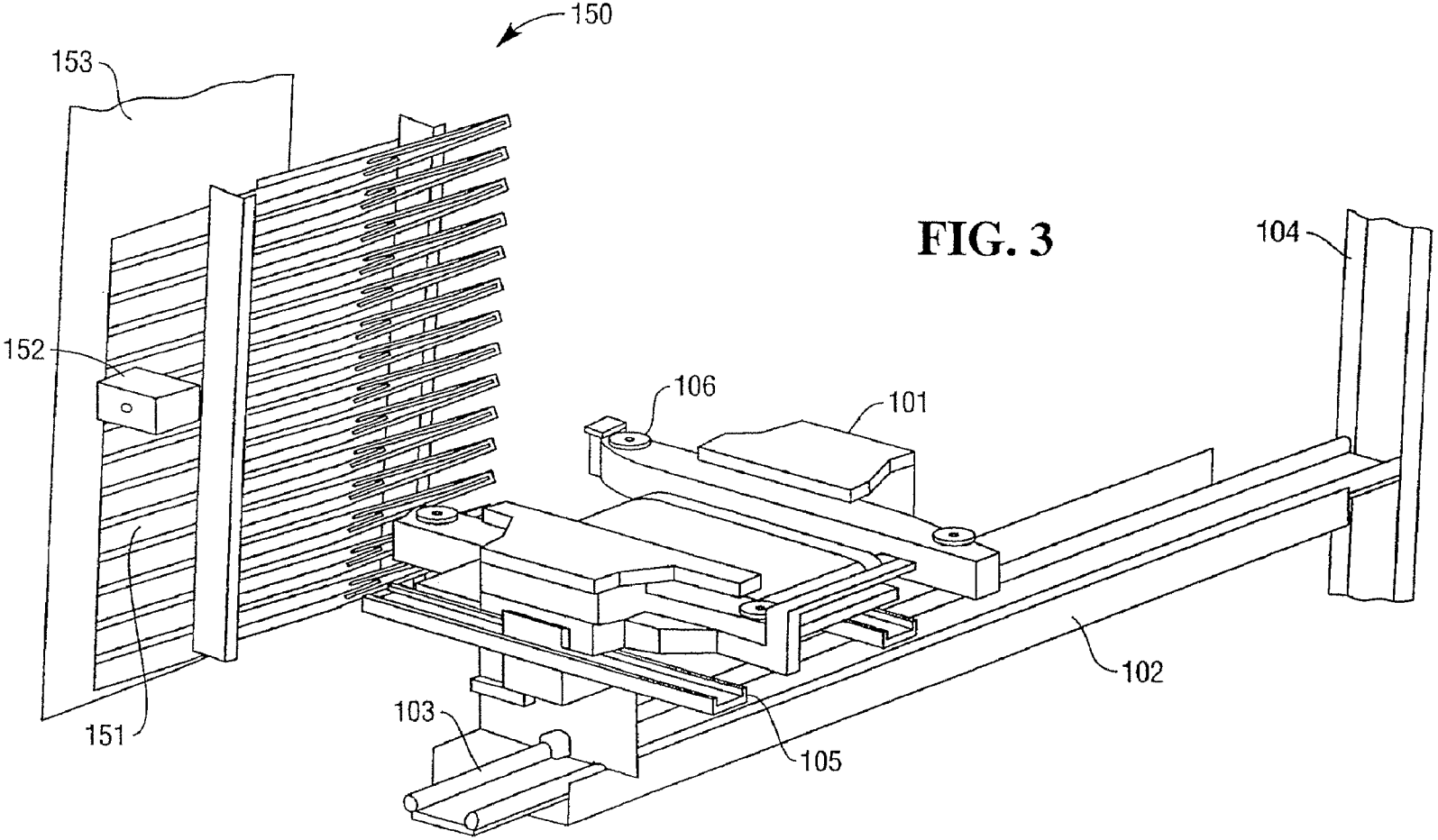
FIG. 3 shows the embodiment of FIG. 1 wherein the shelving system has been partially lowered.
Figure 4:
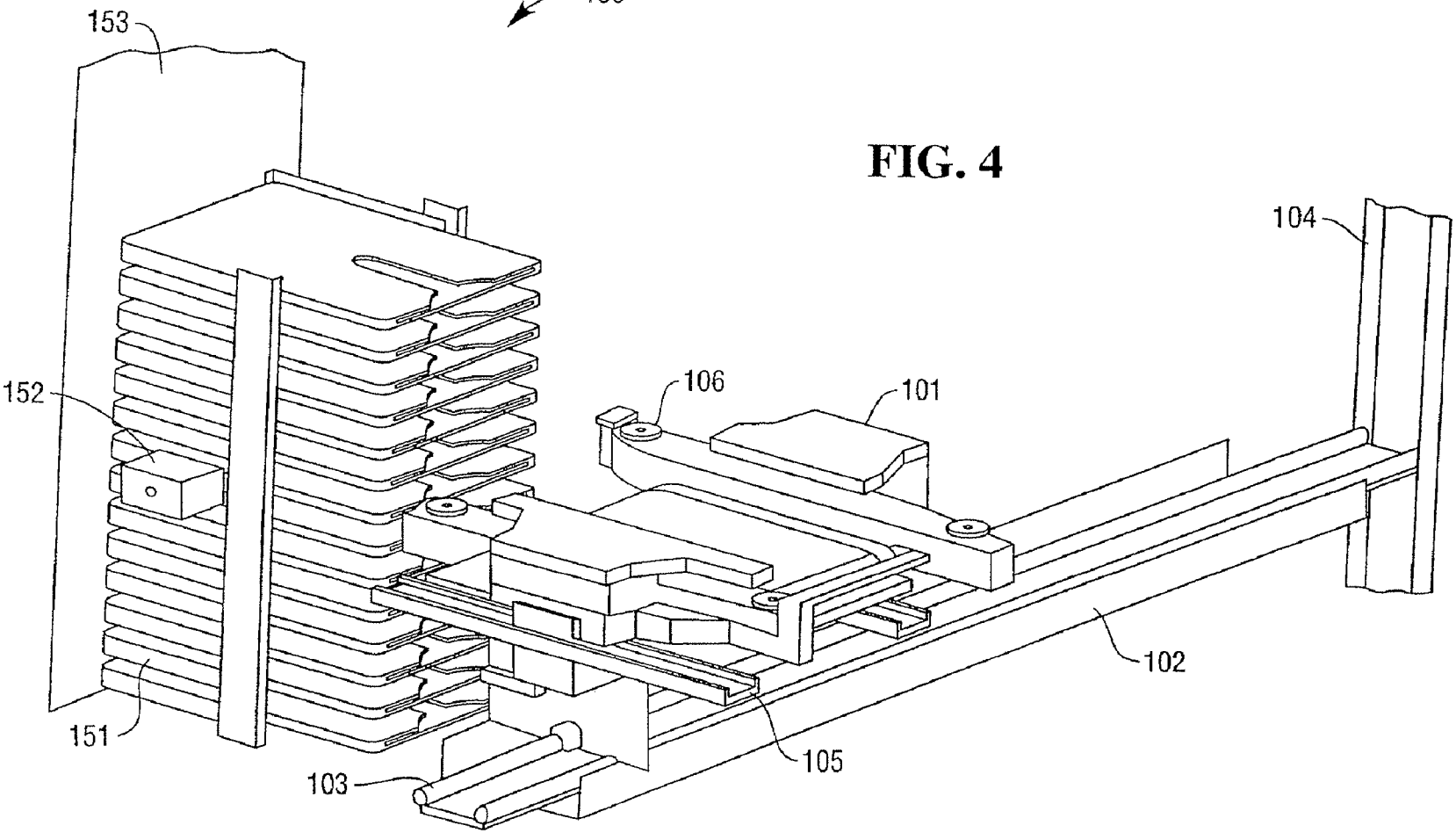
FIG. 4 shows the embodiment of FIG. 1 wherein the shelving system has been lowered to a substantially horizontal position.

As shown in FIGS. 1-7, the shelving system 150 comprises a plurality of shelves that are parallel to one another. Each shelf preferably contains a single DVD. Each DVD may be optionally packaged in a sleeve or other suitable container to protect the DVD from damage during transport. Each shelf is further adapted so that a DVD can slide out of the shelf when pulled by the gripper 101. The shelving system 150 comprises an actuator 152 or other motor capable of lowering the shelves as shown in FIGS. 1-3. Specifically, the individual shelves of the shelving system 150 are preferably attached to a back wall 153 such that the shelves can pivot from an angular position (as shown in FIG. 1) to a horizontal position (as shown in FIG. 4).

In operation, the customer first selects a DVD or CD from the kiosk's computer interface for purchase or rental. The computer then sends one or more signals to the motors that control the movement of the gripper 101 in order to position the gripper 101 in front of the location where the DVD is stored. Specifically, the computer will send a signal to (i) the wheels that control the movement of the gripper arm 102 in a vertical dimension along vertical track 104, (ii) the wheels that control the movement of the gripper 101 in a first horizontal dimension along gripper arm 102, and (iii) the wheels that control the movement of the gripper 101 along gripper track 105 in a second horizontal direction, the second horizontal direction being perpendicular to the first horizontal direction. In some embodiments, one or more relays or controllers may receive the signal from the kiosk's computer and send a different signal to the particular motors associated with the particular wheels.

The kiosk's computer will also send a signal to an actuator 152 that controls the inclination of the shelves in the shelving system 150. In some embodiments, a servo, motor, or other device may be used in place of actuator 152. In some embodiments, one or more relays or controllers may receive the signal from the kiosk's computer and send a different signal to actuator 152. In response to receiving the signal, actuator 152 will lower the shelves in the shelving system 150 from the inclined position (as shown in FIG. 1) to a horizontal position (as shown in FIG. 4). The shelves of shelving system 150 are preferably pivotably attached to a wall 153 inside the kiosk. In alternate embodiments, the shelves of shelving system 150 may be attached to a pair of vertical posts inside the kiosk.

Figure 5:
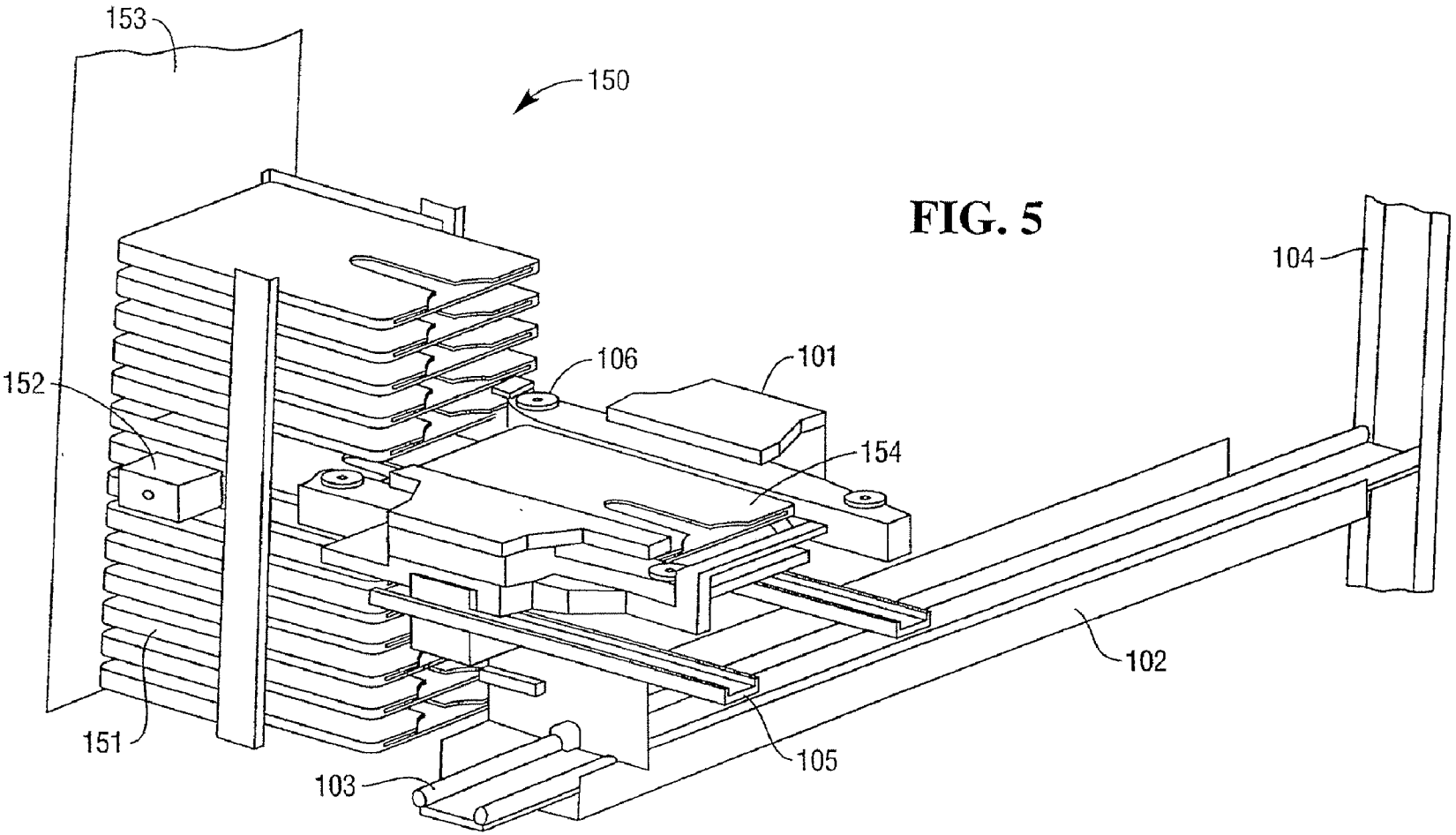
FIG. 5 shows the embodiment of FIG. 1 wherein the gripper has engaged a DVD from the shelving system and partially placed the DVD on the gripper.

After the shelves of the shelving system 150 have been lowered to the horizontal position and the gripper 101 has been positioned in front of the appropriate shelf 151 containing the selected DVD, the gripper 101 will move laterally along the gripper track 105 to engage the selected DVD with gripper wheels 106. The gripper wheels 106 will pull the selected DVD 154 out of shelf 151 and onto the gripper 101, as shown in FIG. 5.

Figure 6:
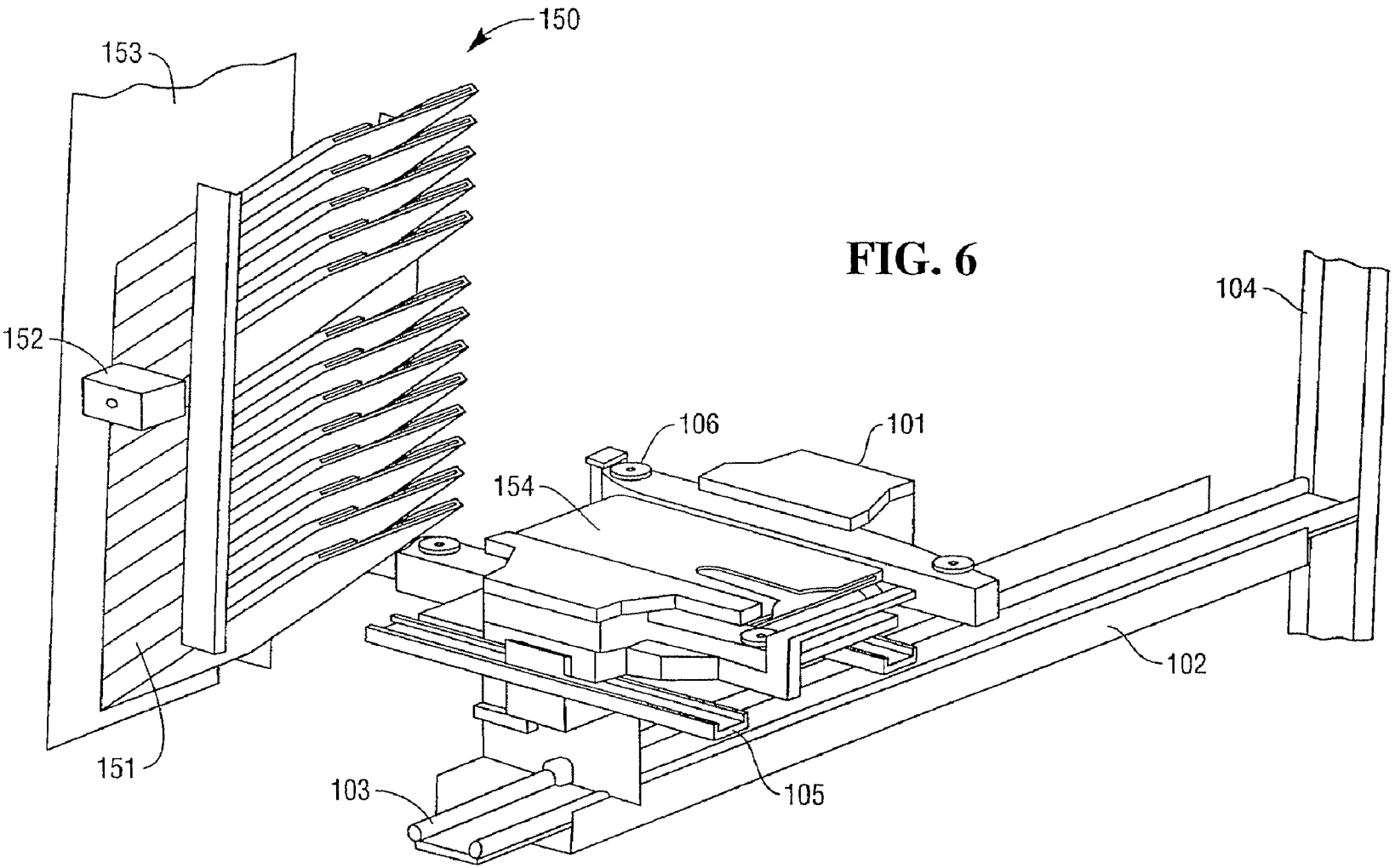
FIG. 6 shows the embodiment of FIG. 1 wherein the gripper has disengaged from the shelving system and wherein the shelving system has been partially raised.
Figure 7:
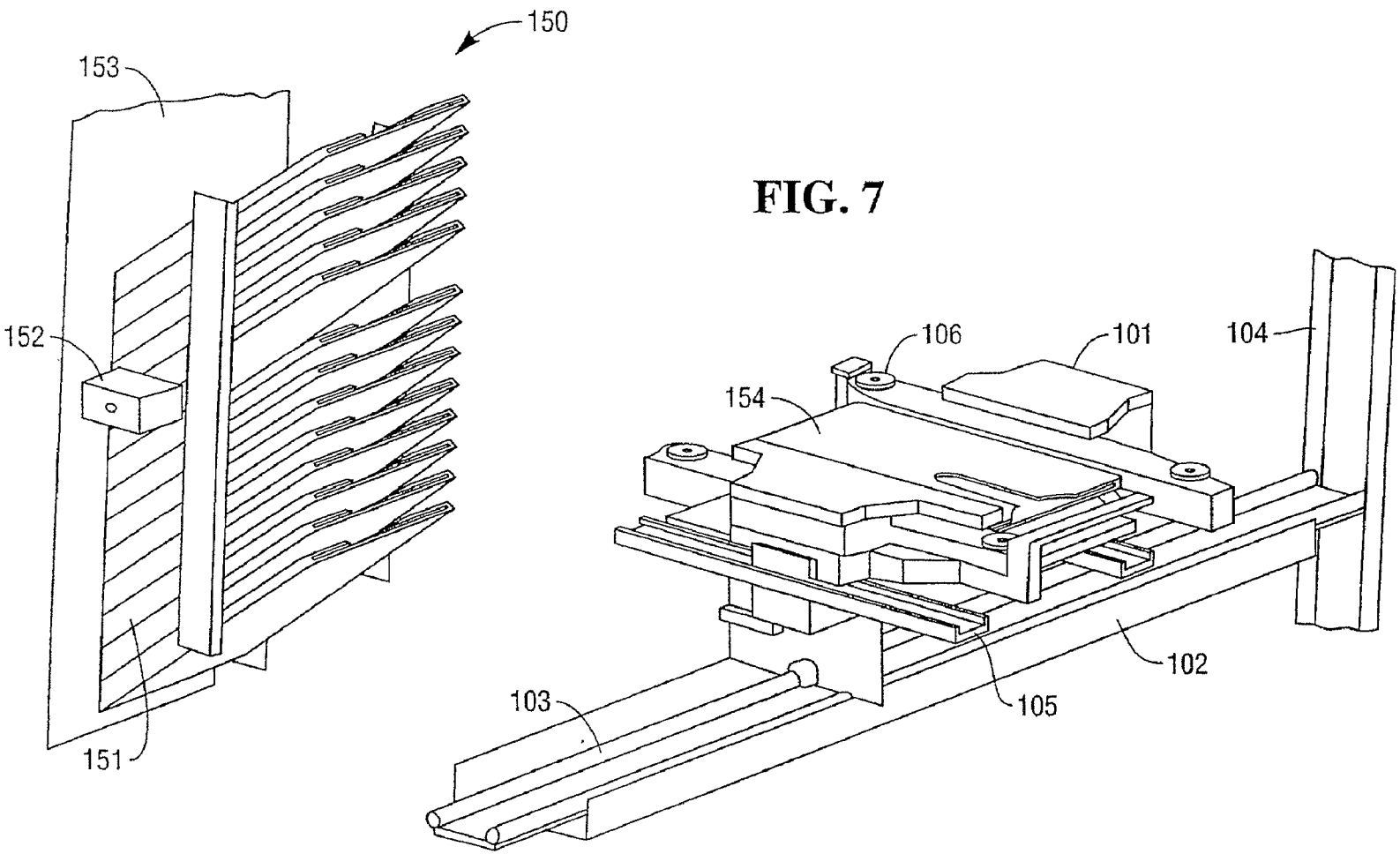
FIG. 7 shows the embodiment of FIG. 1 wherein the gripper has transported the DVD towards a dispenser and wherein the shelving system has been fully raised to its resting, inclined position.

The gripper 101 will then be moved away from shelving system 150 towards the dispenser slot as shown in FIGS. 6-7. Specifically, the gripper 101 will move along gripper track 105 to disengage the shelving system 150. The gripper 101 will also travel along gripper arm 102 to move in a horizontal direction towards the dispenser slot. Finally, the gripper arm 102 will move in a vertical direction along vertical track 104 to ensure that the gripper 101 is positioned appropriately to dispense the DVD at the dispenser slot or chute.

As the gripper 101 moves away from the shelving system 150, the shelving system 150 will retract to the inclined position as shown in FIGS. 6-7. Specifically, actuator 152 will impart a force to shelving system 150 in order to pivot the shelves into an inclined position. In some embodiments, the shelving system 150 will only be retracted after the customer has completed his or her transaction. For example, if the customer selects two DVDs in a single transaction, then the shelving system 150 may not be raised to the inclined position after the gripper 101 retrieves the first DVD. Rather, the shelving system 150 in such an embodiment will only be raised to the inclined position after the gripper 101 has delivered both DVDs to the customer and the transaction is complete.

Accordingly, while the invention has been described with reference to the structures and processes disclosed, it is not confined to the details set forth, but is intended to cover such modifications or changes as may fall within the scope of the following claims.

What is claimed is:

1. A kiosk for dispensing digital versatile disks (DVDs) comprising:

a vertical track oriented in a vertical direction, a gripper arm containing a first horizontal track oriented perpendicularly to said vertical track, said gripper arm being adapted to travel along said vertical track, a second horizontal track oriented perpendicularly to said first horizontal track, said second horizontal track being adapted to travel along said first horizontal track of said gripper arm, a gripper adapted to travel along said second horizontal track, a shelving system comprising a plurality of shelves, said shelves being adapted to move between a substantially horizontal position and an inclined position, and a shelf actuator adapted for moving said shelves.

2. The kiosk of claim 1 wherein said shelves of said shelving system are adapted to hold DVDs.

3. The kiosk of claim 2 wherein said gripper comprises one or more gripper wheels, said gripper wheels being adapted to engage a DVD on a shelf of said shelving system and transport said DVD onto the gripper.

4. The kiosk of claim 3 wherein said gripper arm comprises one or more wheels adapted for travelling along said vertical track.

5. The kiosk of claim 4 wherein said gripper comprises one or more wheels adapted for travelling along said second horizontal track.

6. The kiosk of claim 3 further comprising a computer, said computer adapted for receiving a selection of at least one DVD from a customer, said computer being further adapted to send a control signal to a plurality of motors, said motors being adapted to position the gripper in front of a location where said DVD is stored in said shelving system.

7. The kiosk of claim 6 wherein said computer is further adapted to send a control signal to said shelf actuator, and wherein said shelf actuator is adapted to lower said shelves from an inclined position to a substantially horizontal position.

8. The kiosk of claim 7 wherein said computer is further adapted to send a control signal to said gripper, and wherein said gripper is adapted to engage said DVD and transport said DVD onto said gripper.

9. The kiosk of claim 8 wherein said computer is further adapted to send a control signal to said shelf actuator, and wherein said shelf actuator is adapted to raise said shelves from a substantially horizontal position to a vertical position.

10. The kiosk of claim 9 wherein said computer is further adapted to send a control signal to said gripper, and wherein said gripper is adapted to deliver said DVD to a dispenser.

11. A method for dispensing digital versatile disks (DVDs) from a kiosk, wherein said kiosk comprises (i) a shelving system adapted for holding DVDs, (ii) a gripper adapted for transporting said DVDs, and (iii) a computer adapted for receiving input from a customer, the method comprising:

a) receiving, by said computer, a selection of a DVD title from said customer, b) transmitting a signal, by said computer, to said gripper, wherein said signal contains spatial information about the location of a DVD, c) transmitting a signal, by said computer, to an actuator associated with said shelving system, d) imparting a force, by said actuator, to said shelving system to position the individual shelves of said shelving system from an inclined position to a substantially horizontal position, e) removing, by said gripper, said DVD selected by the customer, and f) transporting, by said gripper, said DVD to a dispenser.

* * * * *